US007633454B2

(12) United States Patent
Weinstein

(10) Patent No.: US 7,633,454 B2
(45) Date of Patent: Dec. 15, 2009

(54) ANTENNA ARRAY SYSTEM AND METHOD FOR BEAMSTEERING

(75) Inventor: Michael E. Weinstein, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 66 days.

(21) Appl. No.: 11/641,769

(22) Filed: Dec. 20, 2006

(65) Prior Publication Data

US 2008/0150824 A1 Jun. 26, 2008

(51) Int. Cl.
*H01Q 19/30* (2006.01)

(52) U.S. Cl. ..... 343/817; 343/815; 343/819; 343/833

(58) Field of Classification Search ..... 343/753, 343/754, 767, 815, 817, 818, 833, 834, 835, 343/819

See application file for complete search history.

(56) References Cited

U.S. PATENT DOCUMENTS

| | | | | | |
|---|---|---|---|---|---|
| 3,599,216 | A * | 8/1971 | Paine et al. | ..... | 343/771 |
| 3,680,142 | A | 7/1972 | Van Atta et al. | | |
| 3,936,835 | A * | 2/1976 | Phelan | ..... | 343/753 |
| 4,150,382 | A | 4/1979 | King | | |
| 4,290,071 | A * | 9/1981 | Fenwick | ..... | 343/819 |
| 4,336,543 | A * | 6/1982 | Ganz et al. | ..... | 343/705 |
| 4,783,661 | A | 11/1988 | Smith | | |
| 5,181,042 | A | 1/1993 | Kaise et al. | | |
| 5,220,335 | A | 6/1993 | Huang | | |
| 5,255,004 | A | 10/1993 | Berkowitz et al. | | |
| 5,771,024 | A * | 6/1998 | Reece et al. | ..... | 343/725 |
| 5,786,793 | A | 7/1998 | Maeda et al. | | |
| 5,818,397 | A | 10/1998 | Yarsunas et al. | | |
| 6,040,806 | A | 3/2000 | Kushihi et al. | | |
| 6,396,442 | B1 | 5/2002 | Kawahata et al. | | |
| 6,445,346 | B2 | 9/2002 | Fathy et al. | | |
| 6,452,568 | B1 | 9/2002 | Zidek | | |
| 6,459,414 | B1 | 10/2002 | Levis et al. | | |
| 6,677,902 | B2 | 1/2004 | Akiyama et al. | | |
| 2003/0052828 | A1 * | 3/2003 | Scherzer et al. | ..... | 343/7 MS |
| 2003/0142028 | A1 | 7/2003 | Mahon | | |
| 2005/0030236 | A1 * | 2/2005 | Durham et al. | ..... | 343/753 |
| 2005/0110683 | A1 * | 5/2005 | Song et al. | ..... | 343/7 MS |

* cited by examiner

*Primary Examiner*—Tho G Phan
(74) *Attorney, Agent, or Firm*—Buchanan Ingersoll & Rooney PC

(57) ABSTRACT

An antenna array system includes a launcher comprising an antenna configured to establish and steer a wavefront, and an array of Yagi-Uda director trains coupled to the launcher and located in the path of the wavefront. The array of Yagi-Uda director trains is configured to influence a beamwidth of the launcher. A method for beam steering includes launching a wavefront generated by an antenna through an array of director elements, and steering the wavefront. The array of director elements focuses the wavefront and influences gain of the antenna over plural steering angles.

35 Claims, 4 Drawing Sheets

Example implementation showing high gain in a steering direction normal to the antenna array Example implementation showing high gain in a steering direction off-normal to the antenna array

ANTENNA ARRAY SYSTEM AND METHOD FOR BEAMSTEERING

BACKGROUND

Individual antenna elements can be configured in an array to produce a radiation pattern with a maximum intensity in a desired direction and reduced intensities in other directions. Antenna arrays are useful for producing a narrow antenna beam that may be electronically steered (scanned), and for increasing antenna gain. An antenna array can be configured in multiple rows of individual antenna elements. Increasing the number of rows of antenna elements employed in the array can narrow the beamwidth and increase the gain. Adding additional rows of antenna elements to the array can increase the cost of implementation.

SUMMARY

An exemplary antenna array system includes a launcher and an array of Yagi-Uda director trains. The launcher comprises an antenna configured to establish and steer a wavefront. The array of Yagi-Uda director trains is coupled to the launcher and located in the path of the wavefront. The array of Yagi-Uda director trains is configured to influence a beamwidth of the launcher.

Another exemplary antenna array system includes means for launching a wavefront and means coupled to the launching means for focusing the wavefront. The focusing means is configured to produce a narrow beamwidth in a plane perpendicular to the launching means.

An exemplary method for beam steering includes launching a wavefront generated by an antenna through an array of director elements, and steering the wavefront. The array of director elements focuses the wavefront and influences gain of the antenna over plural steering angles.

BRIEF DESCRIPTION OF THE DRAWINGS

Other objects and advantages will become apparent to those skilled in the art upon reading the following detailed description of preferred embodiments, in conjunction with the accompanying drawings, in which like reference numerals have been used to designate like elements, and in which.

DETAILED DESCRIPTION

Figure 1:
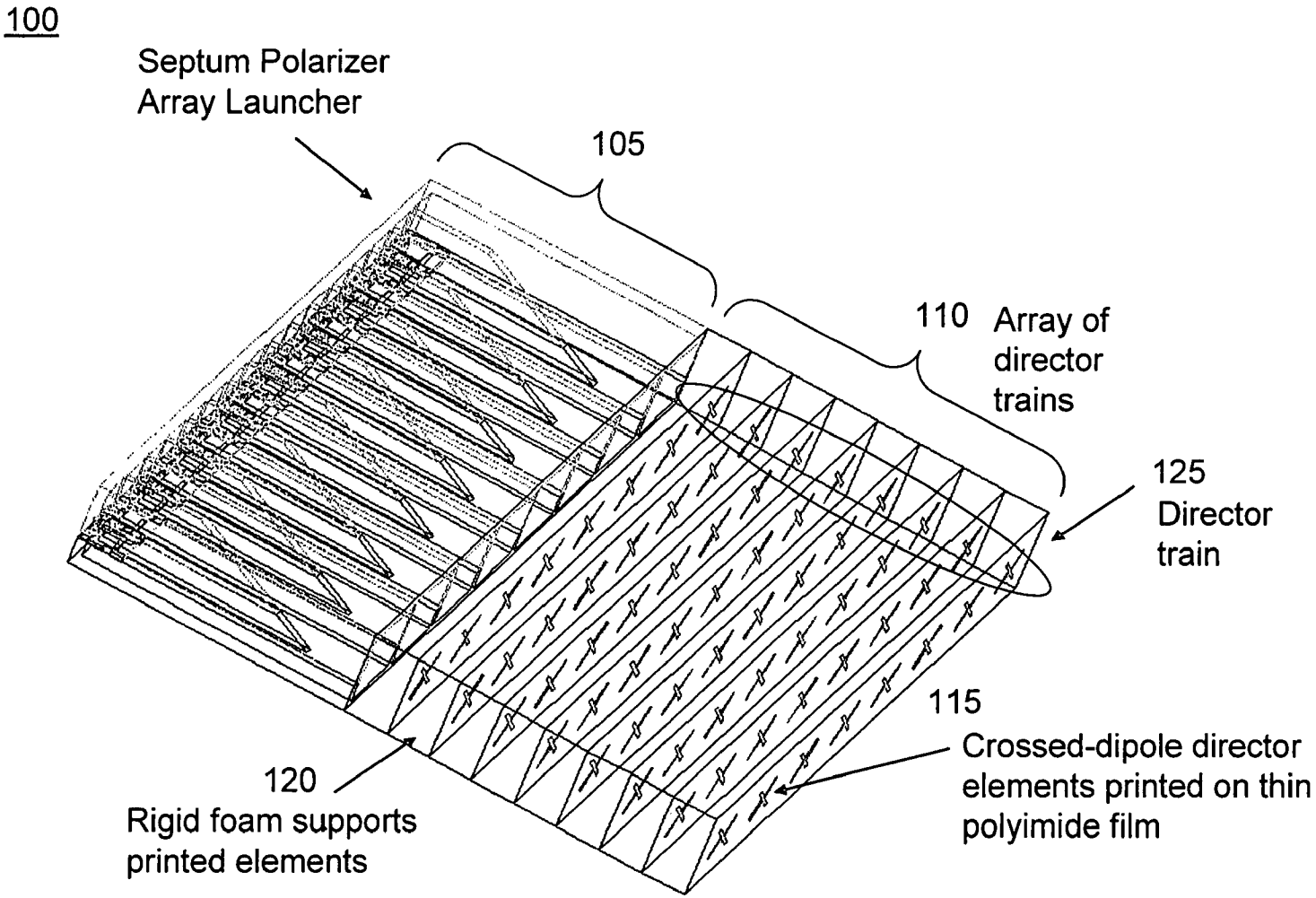
FIG. 1 illustrates an exemplary embodiment of an antenna array system.

FIG. 1 illustrates an exemplary antenna array system 100 that produces an antenna array beamwidth. In accordance with exemplary embodiments, the beamwidth can have any dimension, including, but not limited to, a narrow beamwidth on the order of ten degrees or less. Antenna array system 100 includes means for launching a wavefront, and means coupled to the launching means for focusing the wavefront.

In an exemplary implementation, the launching means comprises an antenna, such as an array 105 of antenna elements. For example, the array 105 can be implemented as a line array, such as a waveguide line array including, but not limited to, a waveguide septum polarizer array, as shown in FIG. 1. Those skilled in the art will understand that the array

105 of antenna elements need not be limited to waveguide line arrays, and can be implemented as an array of other antenna elements, such as an array of patch antennas. Furthermore, the launching means need not be limited to an array of antenna elements, and can be implemented with any suitable mechanism for launching a wavefront into the focusing means including, but not limited to, a reflector that can be electronically or mechanically tilted.

The launching means can establish a wavefront and can change the direction of the wavefront. The launching means is not restricted to a particular type of polarization. For example, the launching means can be implemented with linearly polarized antennas (vertical or horizontal), circularly polarized antennas (right-hand circular or left-hand circular), dual-polarized antennas (e.g., dual-linear or dual-circular) as in exemplary antenna array system 100, or any suitable wavefront establishing and direction changing implementation.

In an exemplary implementation, the focusing means comprises an array 110 of Yagi-Uda director trains 125, as shown in FIG. 1. A Yagi-Uda antenna can be formed as an array of elements, including a reflector element, a driven (e.g., dipole) element, and one or more director elements. Each Yagi-Uda director train 125 shown in the exemplary FIG. 1 embodiment includes plural director elements. The number of director elements in each director train 125 of the array 110 can be varied, and any number of director trains 125 can be used to implement the array 110. Additional arrays 110 of two or more director trains 125 can be combined (e.g., stacked) in any suitable fashion to produce a multi-dimensional array of director trains.

In exemplary embodiments, the Yagi-Uda director elements can be used to focus energy along a forward endfire direction (i.e., as opposed to reflecting energy rearward). For instance, in the exemplary antenna array system 100, the focusing means includes the director train portion of a Yagi-Uda antenna, but need not include the reflector and driven dipole elements. For the antenna array system 100, a reflector element need not be used to launch the wavefront into the director trains 125. Instead, the launching means (i.e., the array 105 of antenna elements) can be used to establish and launch the wavefront.

As shown in FIG. 1, the focusing means is coupled (e.g., directly or indirectly) to the launching means and is located in the path of the wavefront, such that the array 110 of Yagi-Uda director trains 125 passes the wavefront. The array 110 of Yagi-Uda director trains 125 can be used to form an endfire beam that focuses the wavefront energy. In this way, the focusing means can influence the beamwidth of the array 105 of antenna elements, producing a beamwidth that can be, for example, narrow not only in an in-scan plane, parallel to the array 105 of antenna elements, but also in a cross-scan plane, perpendicular to the array 105 of antenna elements. In an exemplary embodiment, the longer each Yagi-Uda director train 125 is, the more narrow the beamwidth that can be achieved in the cross-scan plane.

In the exemplary antenna array system 100, the focusing means has a multi-layer construction, comprising plural alternating layers of printed circuit cards and structural foam layers. As shown in FIG. 1, the array 110 of Yagi-Uda director trains 125 comprises one or more printed circuit cards, each printed circuit card having plural crossed-dipole elements 115 printed on a thin film, such as a polyimide film. A rigid foam 120 is interspersed between the printed circuit cards, providing structural support for the focusing means and doubling as a protective radome.

The crossed-dipole elements 115 provide dual-polarized functionality for the dual-polarized launching means, as shown in FIG. 1, but can also be implemented with other structures depending on the polarization configuration of the launching means. For example, a single, planar, printed structure parallel to the array 105 of antenna elements can contain any or all of the linearly-polarized director elements (dipole elements) used to form the director trains 125 for a linearly polarized launching means. Those skilled in the art will understand that the focusing means can be implemented in other configurations. For example, the Yagi-Uda director trains 125 can be implemented using multiple rod elements instead of printed circuit cards and foam.

As described herein, an exemplary launching means of the antenna array system 100 can comprise an array 105 of antenna elements. In one implementation, the array 105 of antenna elements includes a row of antenna elements. In an exemplary embodiment, additional rows of antenna elements can be used to implement the array 105 to narrow the beamwidth in the cross-scan plane and increase the antenna gain. These features can be achieved without significantly increasing the cost of implementing the array 105 with additional rows of antenna elements and associated electronics. For instance, in the exemplary antenna array system 100, combining the focusing means (e.g., the array 110 of Yagi-Uda director trains 125) with an existing array of antenna elements (e.g., the array 105 of antenna elements) can achieve the effect of adding additional rows of antenna elements to the existing antenna array, without the cost associated with adding additional rows. Furthermore, the array 110 of Yagi-Uda director trains 125 can occupy less space than adding additional rows of antenna elements to the existing antenna array.

The array 110 of Yagi-Uda director trains 125 can not only increase the antenna gain and narrow the beamwidth in the cross-scan plane, but can also narrow the beamwidth in the in-scan plane. Additionally, the array 110 of Yagi-Uda director trains 125 can facilitate a larger antenna element spacing and/or row spacing in the array 105 of antenna elements. Because fewer antenna elements can be employed in the array 105 of antenna elements, cost savings can be achieved.

The array 110 of Yagi-Uda director trains 125 can be used in conjunction with any existing launcher, such as any array of antenna elements, regardless of the number of rows of antenna elements in the array of antenna elements. For example, the array 110 of Yagi-Uda director trains 125 can be used in conjunction with an antenna array having two or more rows of antenna elements combined (e.g., stacked) in any suitable fashion to produce a multi-dimensional array of antenna elements.

Multiple rows of the array 110 of Yagi-Uda director trains 125 can be used in conjunction with any existing launcher, such as any array of antenna elements, having any number of rows of antenna elements. For example, two or more rows of the array 110 of Yagi-Uda director trains 125 can be combined (e.g., stacked) to produce a multi-dimensional array of director trains and used in conjunction with an antenna array having two or more rows of antenna elements combined (e.g., stacked) to produce a multi-dimensional array of antenna elements, where the number of rows of the multi-dimensional array of director trains may or may not equal the number of rows of the multi-dimensional array of antenna elements. The number of director trains in each row of the multi-dimensional array of director trains may or may not equal the number of antenna elements in each row of the multi-dimensional array of antenna elements. The number of director trains and/or the number of director elements within each director train may or may not be equal from row to row of the multi-dimensional array of director trains.

Figure 2:
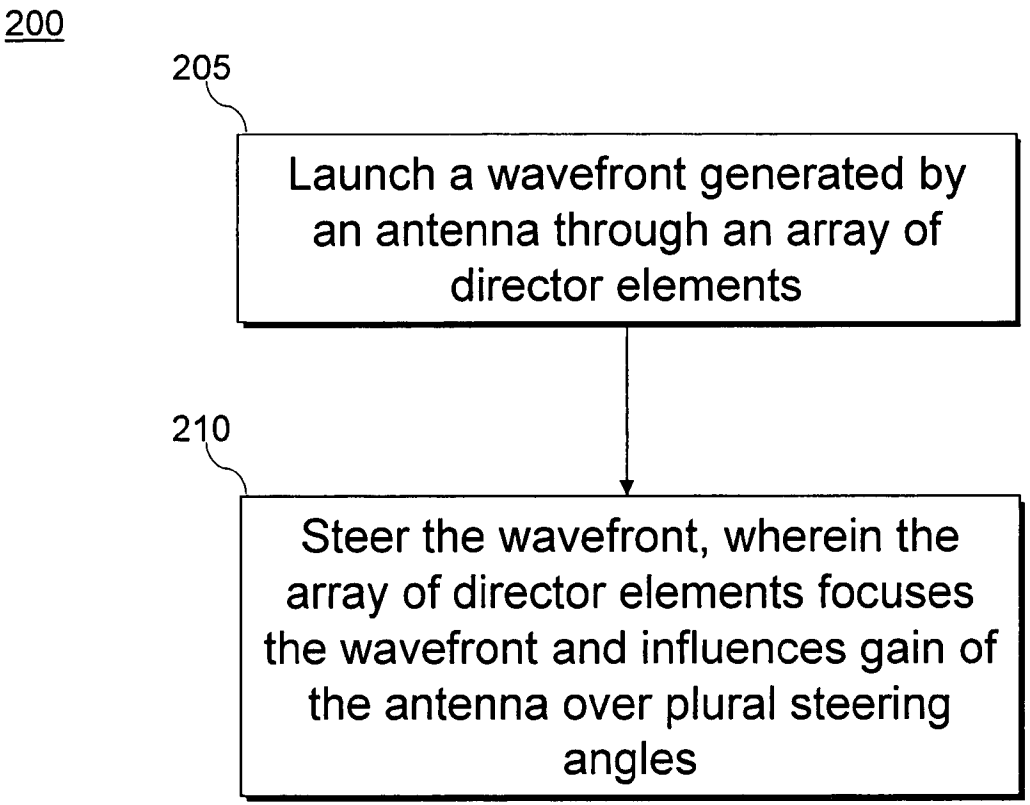
FIG. 2 illustrates an exemplary embodiment of a method for beam steering.

FIG. 2 illustrates an exemplary method 200 for beam steering in accordance with exemplary embodiments which can, for example, achieve low-scan-loss beam steering. Not all of the steps of FIG. 2 must occur in the order shown, as will be apparent to those skilled in the art based on the teachings herein. Other operational and structural embodiments will be apparent to those skilled in the art based on the following discussion.

In step 205, a wavefront generated by an antenna is launched through an array of director elements. The array of director elements can, for example, increase the gain of the antenna. In one implementation, the launching can be accomplished using launching means comprising the array 105 of antenna elements, as described in conjunction with FIG. 1.

In step 210, the wavefront can be steered (e.g., in a direction normal and/or off-normal to the array 105 of antenna elements) to produce, for example, a tilted or non-tilted wavefront. The array of director elements can focus the wavefront and influence (e.g., increase) the gain of the antenna over plural steering angles.

For example, the focusing can be accomplished using focusing means comprising the array 110 of Yagi-Uda director trains 125, as described in conjunction with FIG. 1. The focusing can reduce the beamwidth of the antenna in, for example, a plane perpendicular to a row of antenna elements (i.e., in a cross-scan or elevation plane) and/or reduce the beamwidth of the antenna in a plane parallel to a row of antenna elements (i.e., in an in-scan or azimuth plane).

Exemplary antenna arrays, described herein, can be steered in directions substantially off-normal to the antenna array without a large reduction in antenna gain. Increased gain can be achieved using an array of antenna elements, each element having a narrow beamwidth pattern, but can result in gain reduction when steered in directions off-normal to the antenna array. The exemplary antenna array system 100, having the array 110 of Yagi-Uda director trains 125 coupled to the array 105 of antenna elements, can be used to increase the gain and does not exhibit substantial gain reduction when steered in directions substantially off-normal to the antenna array. This outcome is due, at least in part, to a tilted wavefront propagating through the plurality of director elements 115 such that each Yagi-Uda director train 125 does not function as an individual array element.

Figure 3:
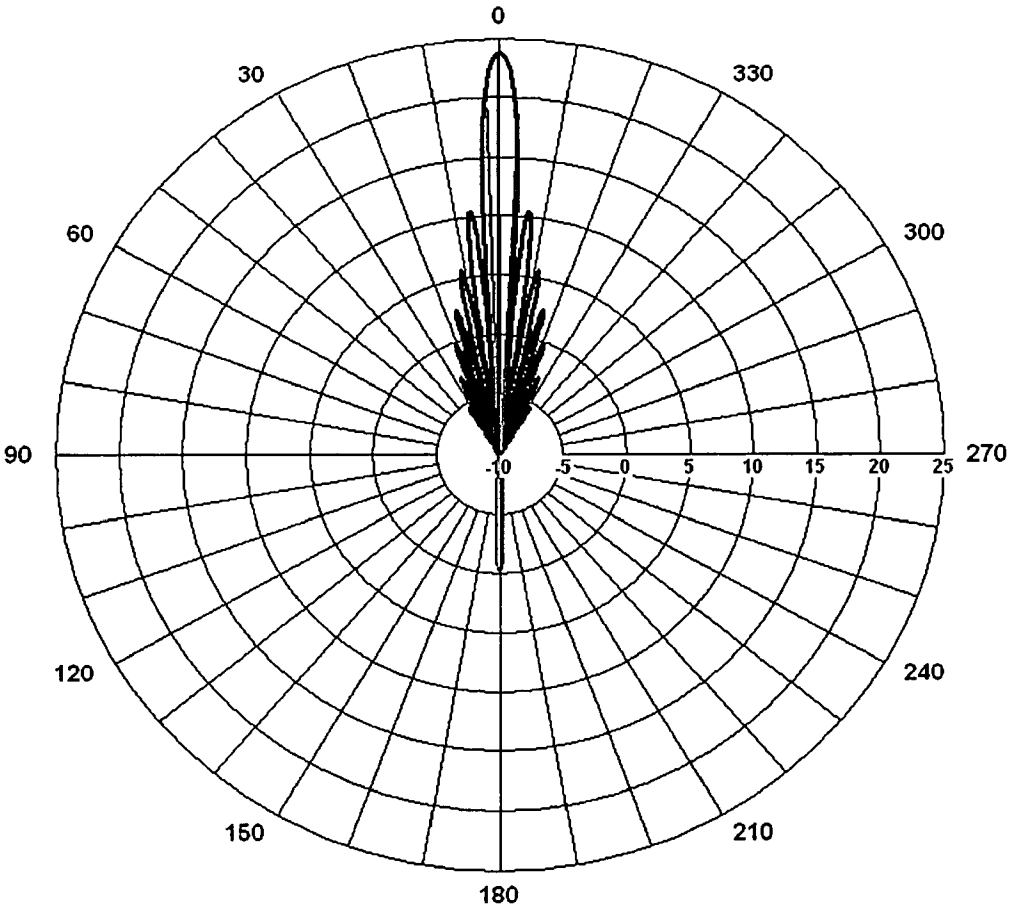
FIGS. 3 and 4 illustrate exemplary antenna patterns produced when simulating an antenna array system for normal and off-normal steering directions, respectively.
Figure 4:
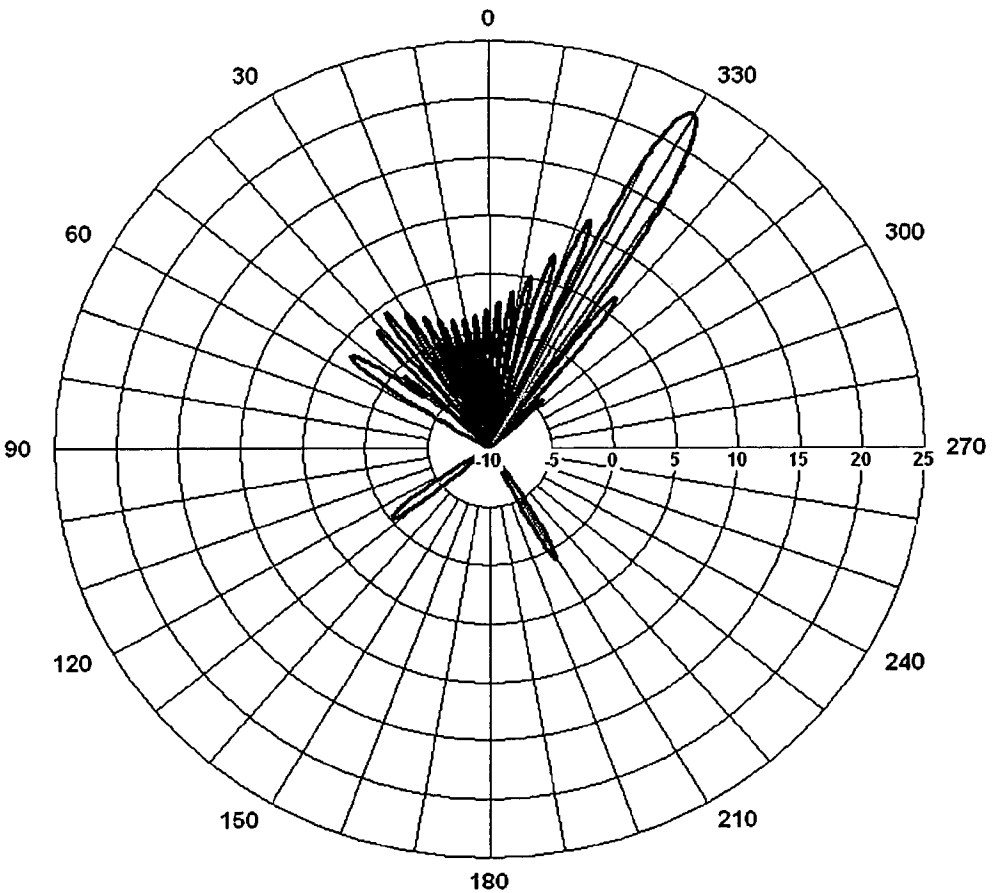

FIGS. 3 and 4 illustrate exemplary antenna patterns produced when simulating the exemplary antenna array system 100 of FIG. 1 for normal and off-normal steering directions, respectively. The pattern of FIG. 3 shows that the antenna array system 100 can be employed to generate a high-gain, narrow beam in a steering direction normal to the antenna array. Similarly, the pattern of FIG. 4 shows that the antenna array system 100 can be employed to generate a high-gain, narrow beam in a steering direction off-normal to the antenna array. For antenna array system 100, the total antenna pattern is a combination of the beams generated by the array 105 of antenna elements as influenced by the array 110 of Yagi-Uda director trains 125. Thus, the Yagi-Uda director trains 125 can be used in conjunction with any suitable phased/electronically steered antenna array to obtain a high-gain, narrow beamwidth pattern in both normal and off-normal scanning directions.

The present invention has been described with reference to exemplary embodiments. However, it will be readily apparent to those skilled in the art that the invention can be embodied in specific forms other than those of the exemplary embodiments described herein. This may be done without departing from the spirit of the invention. These exemplary embodiments are merely illustrative and should not be considered restrictive in any way. The scope of the invention is given by the appended claims, rather than the preceding description, and all variations and equivalents which fall within the range of the claims are intended to be embraced therein.

What is claimed is:

1. An antenna array system, comprising:

a launcher comprising an antenna configured to establish and steer a wavefront; and an array of Yagi-Uda director trains coupled to the launcher and located in a path of the wavefront, wherein:

the array of Yagi-Uda director trains is configured to influence a beamwidth of the launcher;

the array of Yagi-Uda director trains comprises alternating layers of printed circuit cards and structural layers;

the alternating layers of the printed circuit cards and the structural layers comprise a first printed circuit card arranged adjacent to a second printed circuit card with a corresponding structural layer therebetween; and the first printed circuit card is arranged between the antenna and the second printed circuit card.

2. The antenna array system of claim 1, wherein the launcher comprises:

a line array of antenna elements.

3. The antenna array system of claim 1, wherein the launcher comprises:

at least one of a linearly polarized antenna, a circularly polarized antenna, or a dual-polarized antenna.

4. The antenna array system of claim 1, wherein the launcher comprises:

an antenna array having at least one row of antenna elements.

5. The antenna array system of claim 4, wherein the array of Yagi-Uda director trains is configured to produce a narrow beamwidth in a plane perpendicular to the row of antenna elements.

6. The antenna array system of claim 4, wherein the array of Yagi-Uda director trains is configured to produce a narrow beamwidth in a plane parallel to the row of antenna elements.

7. The antenna array system of claim 4, wherein the array of Yagi-Uda director trains is configured to facilitate a larger antenna element spacing in the antenna array.

8. The antenna array system of claim 4, wherein the array of Yagi-Uda director trains is configured to facilitate a larger row spacing in the antenna array.

9. The antenna array system of claim 1, wherein each of the printed circuit cards comprises plural crossed-dipole elements printed on a thin film.

10. The antenna array system of claim 1, wherein the structural layers are foam.

11. The antenna array system of claim 1, wherein each Yagi-Uda director train includes plural dipole elements.

12. The antenna array system of claim 1, wherein the array of Yagi-Uda director trains is configured to influence a gain of the launcher.

13. The antenna array system of claim 12, wherein the array of Yagi-Uda director trains is configured to increase the gain of the launcher.

14. The antenna array system of claim 1, wherein the first printed circuit board and the second printed circuit board are arranged in a first direction substantially orthogonal to a second direction in which the antenna is configured to emit the wavefront, such that the first printed circuit board and the second printed circuit board are arranged in the path of the wavefront.

15. An antenna array system, comprising:

means for launching a wavefront, the launching means including an antenna; and means coupled to the launching means for focusing the wavefront, wherein:

the focusing means is configured to produce a narrow beamwidth in a plane perpendicular to the launching means;

the focusing means comprises an array of Yagi-Uda director trains;

the array of Yagi-Uda director trains comprises alternating layers of printed circuit cards and structural layers;

the alternating layers of the printed circuit cards and the structural layers comprise a first printed circuit card arranged adjacent to a second printed circuit card with a corresponding structural layer therebetween; and the first printed circuit card is arranged between the antenna and the second printed circuit card.

16. The antenna array system of claim 15, wherein the launching means comprises:

a line array of antenna elements.

17. The antenna array system of claim 16, wherein the line array of antenna elements comprises:

a waveguide line array.

18. The antenna array system of claim 16, wherein the focusing means is configured to produce a narrow beamwidth in a plane parallel to the line array of antenna elements.

19. The antenna array system of claim 15, wherein the launching means is configured to establish the wavefront and change a direction of the wavefront.

20. The antenna array system of claim 15, wherein the structural layers are foam.

21. The antenna array system of claim 15, wherein each Yagi-Uda director train comprises:

plural crossed-dipole elements.

22. The antenna array system of claim 15, wherein each Yagi-Uda director train comprises:

plural dipole elements.

23. The antenna array system of claim 15, wherein the focusing means is configured to influence a gain of the launching means.

24. The antenna array system of claim 23, wherein the focusing means is configured to increase the gain of the launching means.

25. The antenna array system of claim 15, wherein each of the printed circuit cards comprises plural crossed-dipole elements printed on a thin film.

26. The antenna array system of claim 15, wherein the first printed circuit board and the second printed circuit board are arranged in a first direction substantially orthogonal to a second direction in which the antenna is configured to emit the wavefront, such that the first printed circuit board and the second printed circuit board are arranged in the path of the wavefront.

27. A method for beam steering, comprising:

launching a wavefront generated by an antenna through an array of director elements, the array of director elements comprising alternating layers of printed circuit cards and structural layers; and steering the wavefront, wherein the array of director elements focuses the wavefront and influences gain of the antenna over plural steering angles, wherein:

the alternating layers of the printed circuit cards and the structural layers comprise a first printed circuit card arranged adjacent to a second printed circuit card with a corresponding structural layer therebetween; and the first printed circuit card is arranged between the antenna and the second printed circuit card.

28. The method of claim 27, wherein the launching comprises:

launching the wavefront generated by a line array of antenna elements.

29. The method of claim 28, wherein the array of director elements produces a narrow beamwidth in a plane perpendicular to the line array.

30. The method of claim 28, wherein the array of director elements produces a narrow beamwidth in a plane parallel to the line array.

31. The method of claim 27, wherein the launching comprises:

launching the wavefront generated by a line array of antenna elements through an array of Yagi-Uda director trains coupled to the line array.

32. The method of claim 27, wherein the array of director elements increases the gain of the antenna over plural steering angles.

33. The method of claim 27, wherein the structural layers are foam.

34. The method of claim 27, wherein each of the printed circuit cards comprises plural crossed-dipole elements printed on a thin film.

35. The method of claim 27, wherein the first printed circuit board and the second printed circuit board are arranged in a first direction substantially orthogonal to a second direction in which the antenna is configured to emit the wavefront, such that the first printed circuit board and the second printed circuit board are arranged in the path of the wavefront.

* * * * *